US005947757A

United States Patent [19]

Ishii

[11] Patent Number: 5,947,757

[45] Date of Patent: Sep. 7, 1999

[54] LEVER-TYPE CONNECTOR

[75] Inventor: Takashi Ishii, Shizuoka, Japan

[73] Assignee: Yazaki Corporation, Tokyo, Japan

[21] Appl. No.: 09/046,575

[22] Filed: Mar. 24, 1998

[30] Foreign Application Priority Data

Mar. 26, 1997 [JP] Japan ..... 9-073560

[51] Int. Cl.[6] ..... H01R 13/62

[52] U.S. Cl. ..... 439/157

[58] Field of Search ..... 439/157, 160

[56] References Cited

U.S. PATENT DOCUMENTS

| | | | |
|---|---|---|---|
| 5,609,494 | 3/1997 | Yamaguchi et al. | 439/157 |
| 5,611,702 | 3/1997 | Okamoto et al. | 439/157 |
| 5,797,758 | 8/1998 | Tsuchiya | 439/157 |

FOREIGN PATENT DOCUMENTS

| | | |
|---|---|---|
| 6-77177 | 10/1994 | Japan . |
| 8-162209 | 6/1996 | Japan . |
| 8-167448 | 6/1996 | Japan . |
| 8-298162 | 11/1996 | Japan . |

*Primary Examiner*—Gary Paumen
*Assistant Examiner*—Briggitte R. Hammond
*Attorney, Agent, or Firm*—Armstrong, Westerman, Hattori, McLeland & Naughton

[57] ABSTRACT

A lever-type connector is provided. A connector housing is provided with support axes. A stopper is formed on the tip of each support axis. Axis holes 4 for receiving the support axes are formed on a lever for connector engagement. The lever is rotatably supported by the connector housing. A stopper is formed by bending and protruding the tip portion of each support axis in one direction. The stopper is bent or protrudes in a direction opposite to the moving direction of the lever. A guide surface for each axis hole is formed on the opposite side of the bent or protruding portion of each stopper. Thus, the support axes of the connector housing and the axis holes of the connector engaging lever can be simplified.

5 Claims, 6 Drawing Sheets

LEVER-TYPE CONNECTOR

BACKGROUND OF THE INVENTION

1. Field of the Invention

The present invention relates to a lever-type connector for engaging the support axes of a connector housing with the axis holes of a connector engaging lever.

2. Related Art

FIGS. 8 to 10 show a conventional lever-type connector (a lever engaging structure) disclosed in Japanese Patent Application Laid-Open No. 8-162209.

This lever-type connector 51 comprises a female connector housing 52 made of a synthetic resin, and a lever 53 also made of a synthetic resin and rotatably attached to a female connector housing 52. Inside the female connector housing 52 is provided a terminal (not shown) which is connected to wires 54. By rotatively moving the lever 53, the lever-type connector 51 can be engaged with the mating male connector only with small force.

In the front of both side walls of the female connector housing 52, support axes 55 in the form of T in cross section is provided for supporting the lever 53. Each support axis 55 is made up of a cylindrical pillar 56 and a pair of protrusions 57 which protrude from both sides of the cylindrical pillar 56.

The lever 53 is provided with axis holes 58 for accommodating the support axes 55, and a circular seating portion 59 is formed around the rim of each axis hole 58 which is made up of a circular portion 60 for engaging the cylindrical pillar 56 of each support axis 55, and rectangular cut portions 61 for inserting the pair of protrusions 57. Locking claws 62 for locking the female connector housing 52 are formed on the tip of the lever 53, while cam grooves for accommodating the follower protrusions of a mating male connector housing (not shown) are formed in the outer half of the lever 53.

As shown in FIG. 8, the support axes 55 are inserted into the axis holes 58, with the lever 53 being pressed forward to adjust the positions of the protrusions 57 of the support axis 55 to the positions of the cut portions 61 of the axis holes 58. The protrusions 57 are rotatively shifted from the cut portions 61 by raising the lever 53 up, as indicated by the broken lines in FIG. 10. Thus, the lever 53 can be prevented from coming off the female connector housing 52. In this position, the lever 53 temporarily engages the mating male connector. By further rotatively moving the lever 53 backward as indicated by the arrow C, the follower protrusions of the mating male connector are moved backward by virtue of the cam grooves of the lever 53. The mating male connector, together with the follower protrusions, is then pulled into the female connector 51, where they are engaged with each other.

With the above conventional structure, however, there is a problem that the axis holes 58 and the seating portions 59, i.e., the bearing portions, are liable to deteriorate in strength, because of the cut portions 61 formed in the axis holes 58 of the lever 53. There is another problem that it is expensive to produce the metal mold for the lever, because the shape of the metal mold becomes inevitably complicated due to the existence of the cut portions 61. There is yet another problem that when engaging the support axes 55 with the axis holes 58, it is necessary to adjust the positions of the protrusions 57 to the cut portions 61, making the production procedure even more complicated.

Meanwhile, FIGS. 11A to 11C show the structures of the support axes and the axis holes of a lever-type connector disclosed in Japanese Patent Application Laid-Open No. 8-167448.

As shown in FIG. 11A, a support axis 66 has a pair of slip-off prevention peripheral members 68 on the tip of a cylindrical pillar 67. A V-shaped splitting groove 69 is formed between the pair of slip-off prevention peripheral members 68. An axis hole 70 includes a circular penetrating portion 71 for accommodating the cylindrical pillar 67 and a circular seating portion 72 for accommodating the pair of slip-off prevention peripheral members 68.

When inserting the support axis 66 into the axis hole 70, the pair of slip-off prevention periphery members 68 bend inward and pass through the penetrating portion 71, as shown in FIG. 11B. After the penetration, the pair of slip-off prevention periphery members 68 expand outward (i.e., return to the original state) to be engaged with the seating portion 72, as shown in FIG. 11C. Thus, the lever 73 can be attached to a connector housing (not shown).

With the above structure, however, the support axis 66 tends to deteriorate in strength because of the splitting groove 69 formed on it. The support axis 66 is liable to slip off the axis hole 70, because the pair of slip-off prevention periphery members 68 will bend inward if a large force is applied to them.

SUMMARY OF THE INVENTION

The principal object of the present invention is to provide a lever-type connector by which the strength of the support axes and axis holes (bearings) are maintained, the production costs of the metal mold without complicating the shapes of the support axes and the axis holes, and the lever can be easily and securely attached to the connector housing.

To achieve the above object, the present invention provides a lever-type connector which comprises: a connector housing; support axes provided on the connector housing; stoppers each provided at the top of each support axis; a lever for engaging the connector; and axis holes for receiving the support axes. The lever is rotatably supported by the connector housing, and each stopper is formed by bending or protruding the tip portion of each support axis in one direction. Each stopper may be bent or protrude in a direction opposite to the moving direction of the lever. A guide surface for each axis hole may be formed on the opposite side of the bent or protruding portion of each stopper.

In accordance with one aspect of the present invention, the production costs of the metal mold can be reduced by simplifying the shape of the support axes. At the same time, the support axes and the axis holes are formed into circular shapes having high resistant properties, so that the strength of the support axes and the axis holes can be maintained, and that they can be prevented from being damaged. Since the support axes can be easily engaged with the axis holes, workability in attaching a lever can be improved. In accordance with another aspect of the present invention, when moved to engage the connector, the lever is secured by the stopper, which surely prevents the lever from slipping off the connector housing. In accordance with yet another aspect of the present invention, when attaching the lever, the axis holes slide along the guide surfaces, so that the support axes can be smoothly engaged with the axis holes. By virtue of the guide surfaces, the clearance between each axis hole and support axis can be small, and the lever can be prevented from wobbling.

The above and other objects and features of the present invention will be more apparent from the following description taken in conjunction with the accompanying drawings.

DETAILED DESCRIPTION OF THE PREFERRED EMBODIMENTS

The following is a detailed description of embodiments of the present invention, with reference to the accompanying drawings.

Figure 1:
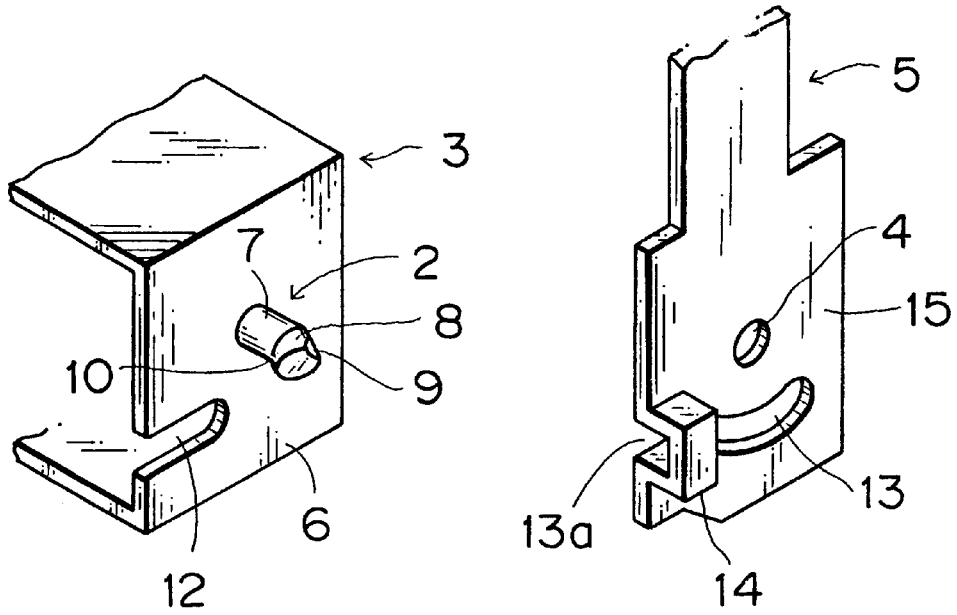
FIG. 1 is an exploded perspective view of one embodiment of a lever-type connector in accordance with the present invention.
Figure 2:
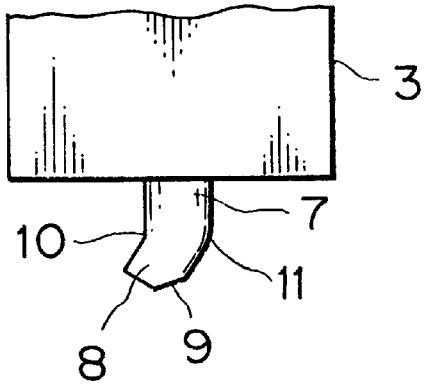
FIG. 2 is a plan view showing the support axis of the connector housing of the lever-type connector.
Figure 3:
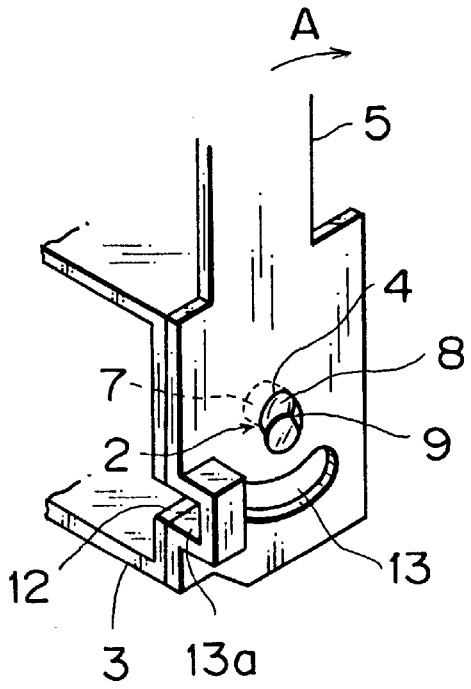
FIG. 3 is a perspective view showing how a lever is attached to the connector housing.

FIGS. 1 to 3 show one embodiment of a lever-type connector (and the engagement structure of a lever) in accordance with the present invention.

A lever-type connector 1 comprises a female connector housing 3 made of a synthetic resin and provided with bent support axes 2 as shown in FIG. 1, and a lever 5 made of a synthetic resin and provided with circular axis holes 4 for accommodating the support axes 2.

Each support axis 2 is made up of a short cylindrical axis main body 7 protruding from a side wall 6 of the female connector housing 3 at a right angle, and a short cylindrical stopper 8 extending diagonally from the axis main body 7. A tapered guide surface 9 is formed on the back edge of the stopper 8, and a curved guide surface 11 is formed on the back of a curved portion 10, as shown in FIG. 2. On the front of the curved portion 10, the axis main body 7 and the stopper 8 cross almost linearly.

As shown in FIG. 1, below the support axis 2, a guide groove 12 is formed on each side wall 6 of the female connector housing 3 in the horizontal direction. The guide groove 12 is engaged with a follower protrusion of a mating male connector housing (not shown). With the lever 5 standing, a cam groove 13 for accommodating the follower protrusion is formed below each axis hole 4. The opening 13*a* of each cam groove 13 is reinforced by a rectangular coupler 14.

The axis hole 4 is engaged with the support axis 2, with the side plate 15 of the lever 5 being inclined. The lever 5 is then rotatably attached to the connector housing 3, as shown in FIG. 3. The attachment of the lever 5 will be fully described later. The stopper 8 of each support axis 2 diagonally protrudes from each axis hole 4 of the lever 5, thereby securing the lever 5. Here, the axis holes 4 are engaged with the respective axis main bodies 7 of the support axes 2.

With the lever 5 standing vertically, the opening 13*a* of each cam groove 13 corresponds to each guide groove 12, so that the follower protrusions of the mating connector (not shown) can be engaged. By rotatively moving the lever 5 rearward as indicated by the arrow A, the mating male connector (not shown) is pulled to be engaged. The stopper 8 of each support axis 2 protrudes in a direction opposite to the moving direction of the lever 5. Thus, when rotatively moved, the lever 5 can be securely engaged with and held by the stoppers 8.

Figure 4:
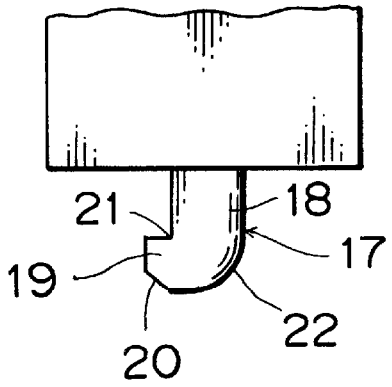
FIG. 4 is a plan view of another embodiment of a support axis in accordance with the present invention.

FIG. 4 shows another embodiment of a support axis.

A support axis 17 comprises a short cylindrical axis main body 18 and a hook-like stopper 19 which is perpendicular to the axis main body 18. The outer diameter of the stopper 19 is a little bit smaller than the outer diameter of axis main body 18. The stopper 19 is not necessarily cylindrical. A tapered guide surface 20 is formed on the edge of the stopper 19, while a curved guide surface 22 is formed on the rear of a curved portion 21. As in the previous embodiment, the guide surfaces 20 and 22 are to guide the axis hole of a lever (not shown). The axis hole is in the form of a circle, also as in the previous embodiment.

Figure 5:
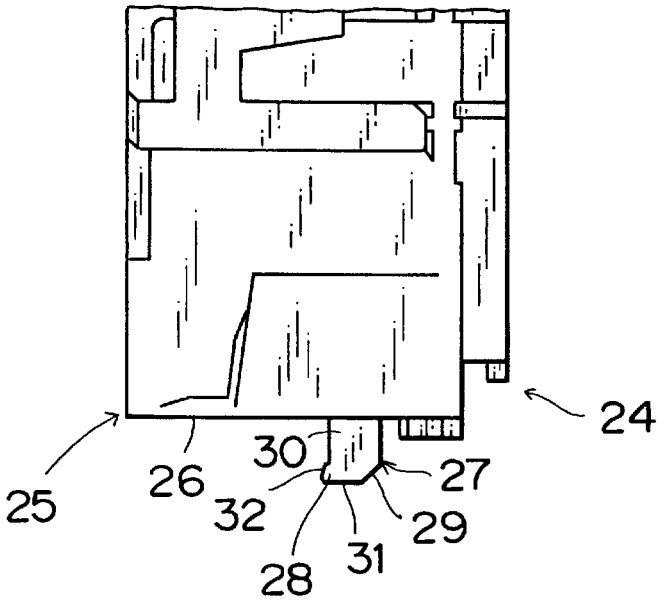
FIG. 5 is a plan view of a connector housing including yet another embodiment of a support axis in accordance with the present invention.
Figure 6:
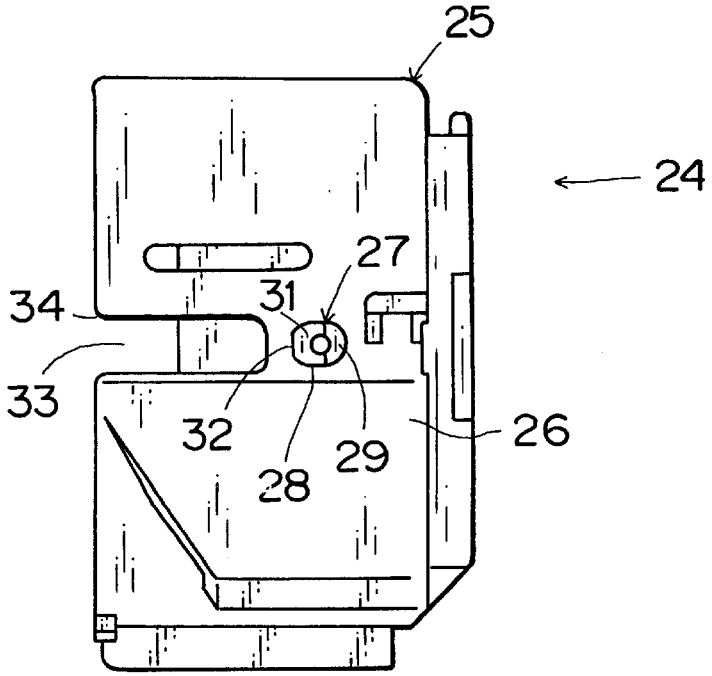
FIG. 6 is a side view of the connector housing.

FIGS. 5 and 6 show another embodiment of a lever-type connector including yet another embodiment of a support axis.

The lever-type connector 24 is provided with a short cylindrical support axis 27 on both side walls of a female connector housing 25 and a flange-like stopper 28 protruding forward from the tip of each support axis 27. A tapered guide surface 29 is formed at the rear of the edge of each support axis 27.

In the front half of each support axis 27, the outer periphery of the flange-like stopper 28 is greater than the outer periphery of the axis main body 30. The tip surface 31 of the stopper 28 is made plane. As shown in FIG. 5, the front tip surface 32 of the stopper 28 is inclined in the same direction as the guide surface 29. As shown in FIG. 6, the front tip surface 32 of the stopper 28 is cut in the vertical direction. With the help of the tapered guide surface 29 at the rear and the cut front top surface 32 at the front, the support axes 27 can be smoothly engaged with the axis holes of a lever (not shown).

A guide groove 33 for accommodating a follower protrusion of a mating connector (not shown) is formed in the front of the female connector housing. The guide groove 33 leads to a front opening 34 for engaging the mating connector. Each support axis 27 is provided with a torsion coil spring (not shown) for encouraging the movement of the lever.

Figure 7A:
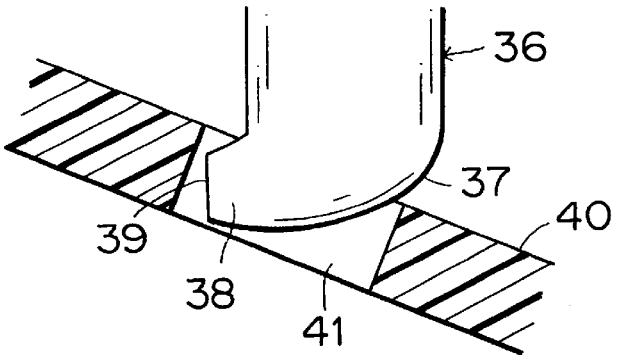
FIGS. 7A to 7C are sectional views illustrating how the axis hole of a lever is engaged with a support axis.
Figure 7B:
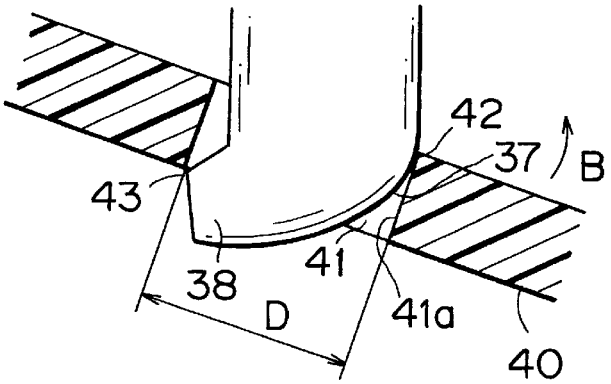
Figure 7C:
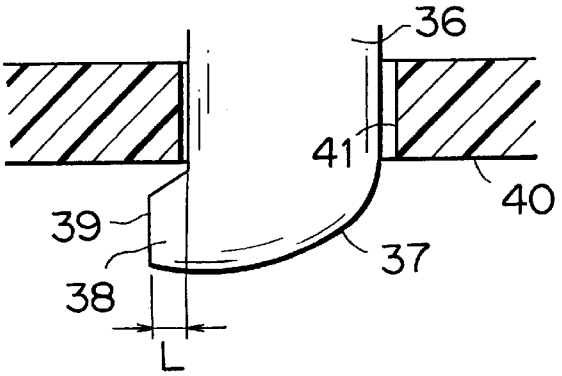
Figure 8:
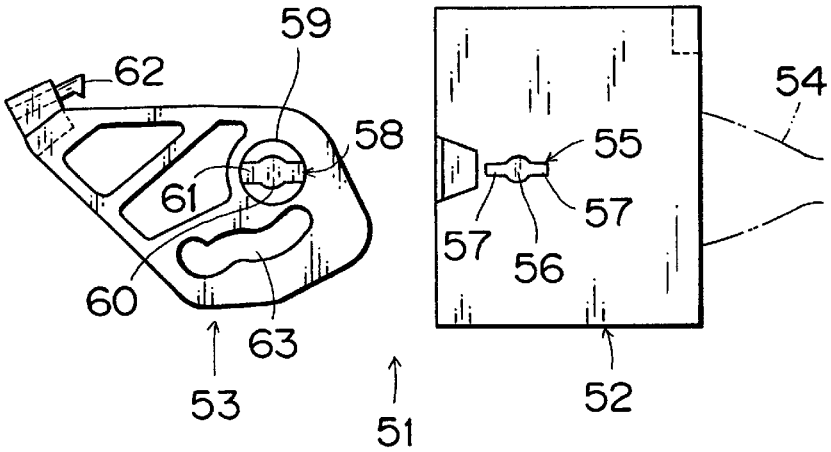
FIG. 8 PRIOR ART
FIG. 8 is a side view of one conventional embodiment of a connector housing and a lever.
Figure 9:
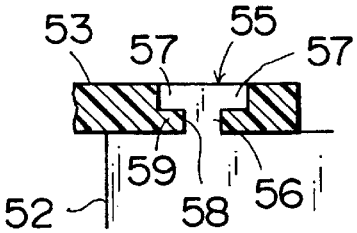
FIG. 9 PRIOR ART
FIG. 9 is a schematic sectional view illustrating how the lever is attached to the connector housing.
Figure 10:
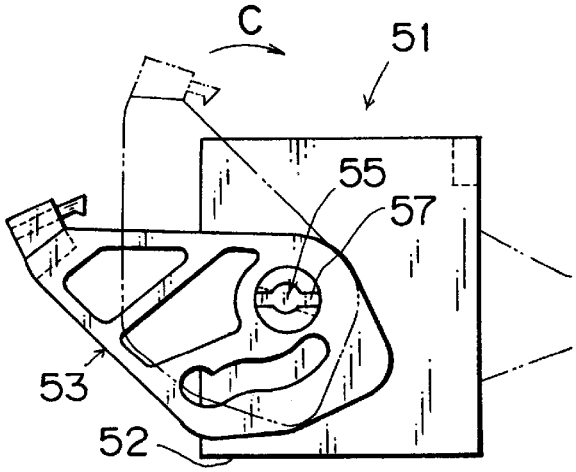
FIG. 10 PRIOR ART
FIG. 10 is a side view illustrating how the lever is attached to the connector housing.
Figure 11A:
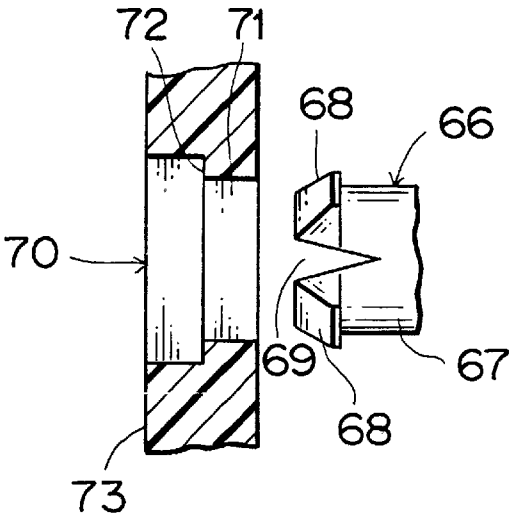
FIG. 11A PRIOR ART
FIGS. 11A to 11C are sectional view showing another conventional embodiment of a lever to be attached to a connector housing.
Figure 11B:
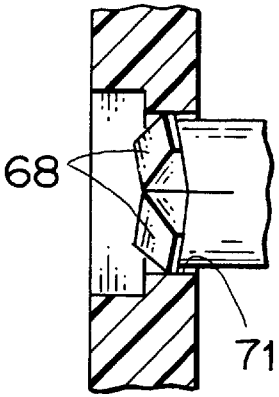
FIG. 11B PRIOR ART
Figure 11C:
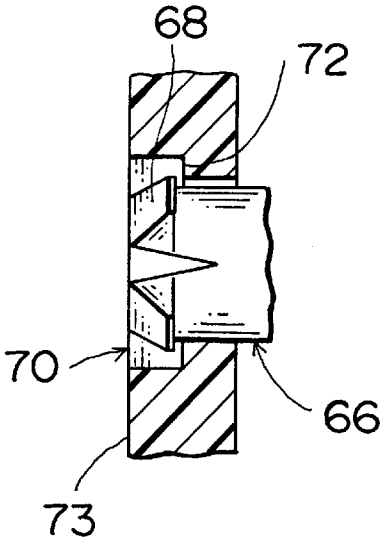
FIG. 11C PRIOR ART

FIGS. 7A to 7C illustrate how a lever is engaged with a support axis.

A support axis 36 is provided with a curved guide surface 37 at its tip portion, and the front of the top portion leads to a stopper 38. The front tip surface 39 of the stopper 38 is made flat. The length between the front tip surface 39 and the outer diameter of the support axis 36 is indicated as a stopping portion L for a lever 40 in FIG. 7C.

To attach the lever 40, an axis hole 41 is positioned diagonally to the support axis 36 as shown in FIG. 7A, and the stopper 38 is inserted into the axis hole 41. As the stopper 38 passes through the axis hole 41, the lever 40 is rotatively moved in a direction indicated by an arrow B, as shown in FIG. 7B, so that the rear 41*a* of the axis hole slides along the curved guide surface 37. Inner diameter D of the axis hole 41 is substantially equal to the length between the rear end 42 of the support axis 36 and the front end 43 of the stopper 38. Thus, the support axis 36 can be smoothly engaged with the axis hole 41, as shown in FIG. 7C. The clearance between the axis hole 41 and the support axis 36 is extremely small, so the lever 40 can be supported by the support axis 36 never to wobble. Since the lever 40 never wobbles during operation, it will not come off the support axis 36.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A lever-type connector, comprising:

a connector housing;

support axes provided on said connector housing, each of said support axes having an axis main portion and a top portion as a stopper provided at a top of said axis main portion; and a connector engaging lever rotatably supported by said connector housing, said connector engaging lever having axis holes each for receiving corresponding one of said support axes, wherein said top portion is inclined with respect to said axis main portion.

2. The lever-type connector according to claim 1, wherein said stopper is inclined in a direction opposite to a moving direction of said connector engaging lever.

3. The lever-type connector according to claim 1 or 2, wherein a guide surface for allowing said stopper to be inserted into said axis hole is formed on an outer surface of said stopper at a side thereof opposite to an inclined direction of said stopper.

4. The lever-type connector according to claim 1, wherein a guide groove for engaging a follower protrusion of a mating connector is horizontally formed on each side wall of said connector housing.

5. The lever-type connector according to claim 1, wherein a cam groove for accommodating each follower protrusion of the mating connector is formed below each axis hole of said connector engaging lever standing vertically.

* * * * *